United States Patent [19]

Bräuninger

[11] Patent Number: 4,726,335

[45] Date of Patent: Feb. 23, 1988

[54] METHOD OF AND DEVICE FOR SAFEGUARDING OPERATION OF AN INTERNAL COMBUSTION ENGINE

[75] Inventor: Jürgen Bräuninger, Stuttgart, Fed. Rep. of Germany

[73] Assignee: Robert Bosch GmbH, Stuttgart, Fed. Rep. of Germany

[21] Appl. No.: 856,649

[22] Filed: Apr. 25, 1986

[30] Foreign Application Priority Data

Jun. 8, 1985 [DE] Fed. Rep. of Germany ..... 3520660

[51] Int. Cl.[4] ..... F02M 39/00

[52] U.S. Cl. ..... 123/198 D; 137/567; 123/179; 123/514

[58] Field of Search ..... 123/179 L, 198 D, 510, 123/514, 511, 512, 497; 137/567, 506

[56] References Cited

U.S. PATENT DOCUMENTS

| | | | |
|---|---|---|---|
| 2,314,900 | 3/1943 | Samiran | 123/198 D |
| 2,823,518 | 2/1958 | Murray | 137/567 |
| 2,835,323 | 5/1958 | Booth | 137/567 |
| 2,944,597 | 7/1960 | Wilson | 137/567 |
| 3,010,509 | 11/1961 | Scherenberg | 137/567 |
| 3,254,697 | 6/1966 | Parks | 137/567 |
| 3,259,066 | 7/1966 | Williams | 137/567 |
| 3,602,256 | 8/1971 | Olszfwski | 137/567 |
| 4,296,718 | 10/1981 | Baugh | 123/198 D |
| 4,346,689 | 8/1982 | Neely | 123/198 D |
| 4,501,251 | 2/1985 | Kelch | 123/198 C |
| 4,546,745 | 10/1985 | Brotherston | 123/198 D |
| 4,590,904 | 5/1986 | Wannenwetsch | 123/179 L |

*Primary Examiner*—Carl Stuart Miller

*Attorney, Agent, or Firm*—Michael J. Striker

[57] ABSTRACT

A method of safeguarding operation of an internal combustion engine is based on the provision of two electrically controlled fuel supply pumps delivering fuel from a tank to a fuel metering device. During the start of the engine both fuel supplying pumps are activated. During a normal engine operation when rotary speed exceeds an iling value, a random fuel supplying pump is turned off. In a defect situation resulting from malfunction of the active pump both pumps are turned on to maintain fuel supply by the other pump. In an emergency situation when for example actual rotary speed exceeds a maximum value, both fuel supplying pumps are activated in reverse to suck fuel from the metering device and cause the standstill of the engine.

12 Claims, 1 Drawing Figure

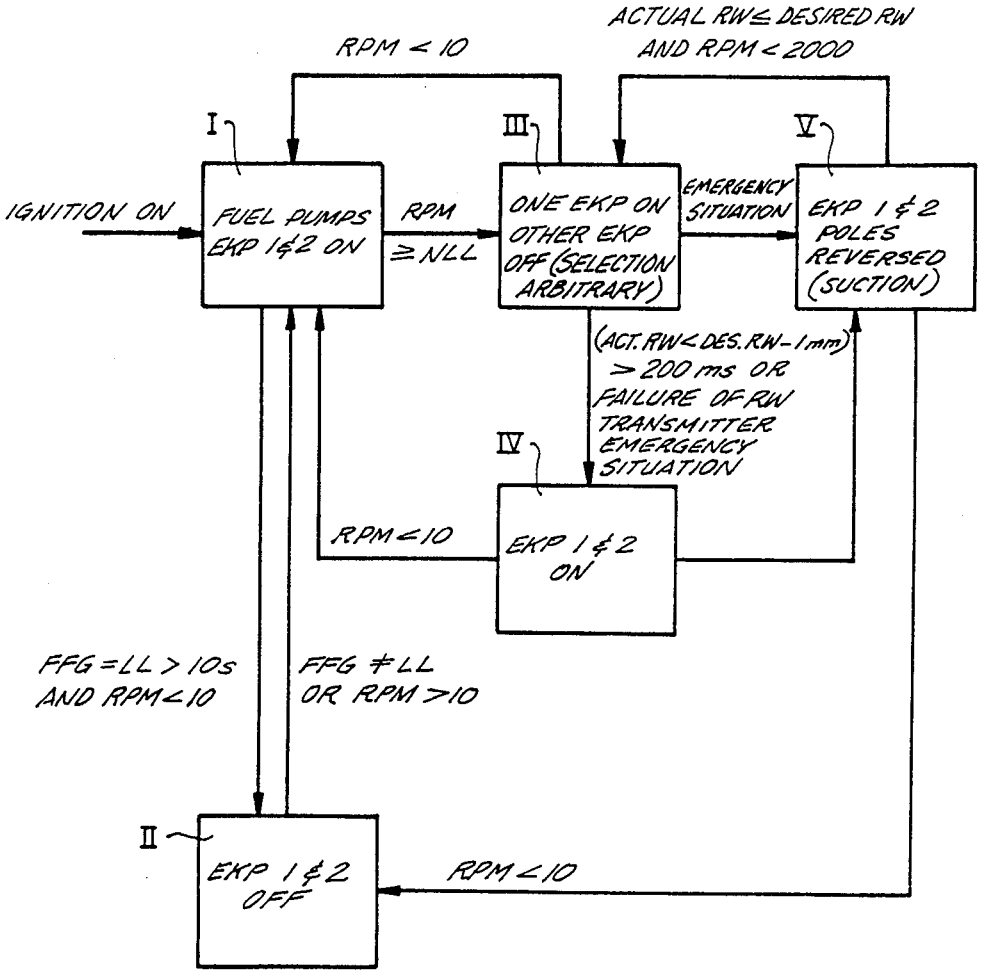
ACTUAL RW ≤ DESIRED RW
AND RPM < 2000
RPM < 10
I
III
V
IGNITION ON
FUEL PUMPS
EKP 1 & 2 ON
RPM
≥ NLL
ONE EKP ON
OTHER EKP
OFF (SELECTION
ARBITRARY)
EMERGENCY
SITUATION
EKP 1 & 2
POLES
REVERSED
(SUCTION)
(ACT. RW < DES. RW - 1mm)
> 200 ms OR
FAILURE OF RW
TRANSMITTER
EMERGENCY
SITUATION
IV
RPM < 10
EKP 1 & 2
ON
FFG = LL > 10s
AND RPM < 10
FFG ≠ LL
OR RPM > 10
II
EKP 1 & 2
OFF
RPM < 10

METHOD OF AND DEVICE FOR SAFEGUARDING OPERATION OF AN INTERNAL COMBUSTION ENGINE

BACKGROUND OF THE INVENTION

The present invention relates to a method of safeguarding operation of an internal combustion engine, particularly of a Diesel engine having a fuel tank, a fuel metering device, an electrically controlled fuel pump for supplying fuel from the tank to the metering device, means for injecting fuel into cylinders of the engine in response to momentary operational conditions of the engine.

To supply fuel from a tank to fuel metering systems of an internal combustion engine via electrically controlled fuel pumps is known from prior art. The metering systems can include carburators of an arbitrary shape and design or arbitrary fuel injection devices. In the case of self-igniting internal combustion engines (Diesel engines) there are usually provided mechanically driven fuel injection pumps whose delivery of fuel to be injected is determined by a hydraulic or magnetic control mechanism. Even in the latter case fuel is supplied to a high pressure fuel injection pump via a low pressure electrically controlled fuel supply pump. Especially in the case of Diesel engines the safety considerations must be taken into account because a control rod which determines the delivered fuel quantity in series connected fuel injection pumps may become accidentally clamped for example due to the intrusion of a foreign particle or due to the effect of other interferences and an emergency situation in the engine operation may occur.

SUMMARY OF THE INVENTION

It is, therefore, a general object of the present invention to safeguard the operation of the engine even in the case of such emergency situations.

In particular it is an object of this invention, especially in the case of Diesel engines, to adjust the supply of fuel to the fuel metering system in such a manner as to guarantee normal operation on the one hand, and in emergency situations or in the case of a malfunction to immediately react for example by stopping the engine, on the other hand.

In keeping with these objects and others which will become apparent hereafter, the method of this invention includes the steps of providing an additional electrically controlled fuel pump for supplying fuel from the tank to the metering device, during starting operation when rotary speed of the engine has a low value n being less than an idling speed, activating both fuel supply pumps, during a normal engine operation when rotary speed n is larger than the idling speed, activating at random only one of the two fuel pumps to supply to the metering device in approximately equally distributed running times of the two pumps, and in an emergency situation when an actual rotary speed exceeds a predetermined speed limit for a predetermined time interval, activating both fuel pumps in reverse run to suck fuel from the metering device.

The invention has the advantage that in normal engine operation a considerable safety redunancy results from the provision of two randomly activated fuel supply pumps. Due to the monitoring of operational conditions of the engine, namely the rotary speed, the difference between the actual and nominal values of the gas pedal position and in the case of a Diesel engine, the actual and nominal positions of a control rod which determines the quantity of injected fuel, or the nominal and actual values of load in all types of engines and the processing of the latter either in separate evaluation and control devices for the fuel supply pumps or in connection with existing computers or microprocessors, it is guaranteed that in operational conditions leading to emergency situations the two fuel supply pumps are operated in reverse running so as to immediately bring the engine to a standstill.

It is also of advantage that actuation or running times of the two fuel supply pumps are substantially equally distributed because in spite of slightly increased expenditures due to the doubled actuation, in the end effect the increased expenditures are compensated for in emergency situations when due to the reversal of running of the two fuel supply pumps a substantially faster removal of fuel present in the fuel metering system or in the fuel injection pump of a Diesel engine, a faster stoppage of the engine is achieved.

The device of this invention includes a controlling device for the two fuel supply pumps which can be with advantage designed in such a manner to monitor the operational conditions of the two pumps and in the event of a defect detected in one of said pumps, to automatically switch over the operation to the remaining pump. A defective pump operation can be recognized for example from the comparison of a stored nominal value of the regulating or control mechanism with the actual value thereof then the two fuel supply pumps are switched on for forward delivery.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE illustrates a flow chart of different modes of actuation of the two fuel supply pumps in response to different operational conditions of the engine.

DESCRIPTION OF THE PREFERRED EMBODIMENTS

This invention is based on the provision of two parallel operating electrically controlled fuel supply pumps EKP1 and EKP2 for delivering fuel to a metering or injection device of an internal combustion engine and to control via a central controlling device the actuation of respective fuel supply pumps in response to operational conditions of the engine.

The following description of an example of this invention is concerned with the operation of a Diesel engine having an electronic fuel injection control (EVC) which applies the requisite control signals to a control mechanism for the operation of a fuel injection pump EP. It will be noted however that this invention is not limited to this specific exemplary embodiment but can be used for other types of internal combustion engines. Moreover, the control unit or device generating particular control signals for the operation of respective fuel supply pumps EKP1 and EKP2 according to various operational conditions of the engine can be realized either by hardware or completely or partially by a program in a supervisory central control device (a computer or microprocessor) controlling the overall operation of the engine or of the motor vehicle.

In the present example, as mentioned before, the two electrically controlled fuel supply pumps EKP1 and EKP2 supply fuel to a non-illustrated fuel injection pump EP regulated by an electronic Diesel engine controlling device EVC.

Referring now to the drawing, the actuation of respective fuel supply pumps EKP1 and EKP2 is controlled in response to different operational engine conditions as follows:

1. After turning on ignition during starting operation a control device for the two fuel pumps activates both pumps EKP1 and EKP2 to deliver fuel simultaneously as indicated in block I;

2. If during the starting operation the control device detects that a. the rotary speed of the engine approaches zero (n less than 10 rpm) and simultaneously b. the gas pedal position FFG remains zero (LL) for a predetermined time interval $\Delta T$ then both pumps EKP1 and EKP2 are turned off as indicated in block II.

3. If during the condition of turned off pumps the actual rotary speed exceeds a predetermined minimum value (n greater than 10 rpm) or if the gas pedal position becomes greater than zero then both fuel supply pumps EKP1 and EKP2 are reactivated (block I).

4. If during the staring condition corresponding to the block I (both fuel supply delivering) the rotary speed of the engine exceeds idling speed (n greater or equal to $n_{LL}$) then a random one of the two active fuel supply pumps is turned off and only the other fuel supply pump continues the delivery so that then the engine is in its normal mode of operation (block III).

5. If during this normal operation the control device detects drop of rotary speed below the predetermined minimum value (n less than 10 rpm) then the turned off fuel supply pump is reactivated and the operation of both pumps EKP1 and EKP2 is controlled again according to the blocks I and II pertaining to the staring condition of the engine.

6. During the normal engine operation the control device monitors for malfunction or an emergency engine operation. Such an abnormal condition is detected for example when the difference between the actual and the nominal value of the regulating signal of the control rod is greater than a predetermined limit stored in a computer memory and the transgression of the regulating difference lasts longer than a stored time limit interval $\Delta T_{lim}$. In this event a fault or an emergency operation has been detected. Such a transgression of the regulating difference resulting as explained above from the condition that the actual regulating value is less than a desired or nominal regulating value whereby the difference between the regulating difference and a limit value when applied to the position of control rod, can be expressed in length units for example in millimeters (RW actual less than IW nominal by one millimeter). In this defect condition which occurs also during malfunction of the active pump, both fuel supply pumps EKP1 and EKP2 are switched on for delivery as indicated in Block IV. This defect condition is not established when a. the preceding conditions are detected while the difference between actual and nominal regulating values is positive, that means when the nominal value is smaller than the actual value (emergency situation);

b. when the preceding condition was an emergency situation (which will be explained below in connection with block V) and a predetermined stored time interval $\Delta T_{look}$ had not yet expired.

7a. The above mentioned condition 6a (nominal regulating value is less than the actual value) represents an emergency situation when the difference exceeds a predetermined limit and simultaneously the actual rotary speed exceeds a predetermined value for a predetermined time limit interval. By way of an example, the emergency situation will occur when RW actual is greater than RW nominal plus 1 millimeter and rotary speed is greater than 1000 rpm, both conditions lasting more than a predetermined time interval $\Delta T_{lim}=200$ milliseconds.

b. The emergency operational condition results also upon the detection of overspeed, that means when the actual rotary speed exceeds a predetermined speed limit value for a predetermined limit time interval, for example when rotary speed is greater than 2,700 rpm over $\Delta T_{lim}$ of 20 milliseconds.

Upon the detection of an emergency situation during the engine mode of operation correspondings to blocks III and IV, both fuel supply pumps EKP1 and EKP2 are switched over into reverse run so that they suck out fuel from suction space of a fuel injection pump EV, as indicated in block V. The switchover into reverse can be effected for example by the reversal of polarity of electrical terminals of the two pumps.

8. From the emergency mode of operation the reverse delivery of the pumps can be returned to their normal forward delivery according to block III under the condition that the actual regulating value $RW_{ist}$ is smaller or equal to the nominal regulating value $RW_{soll}$ and the actual rotary speed of the engine is smaller than a predetermined lower speed limit value, for example n is less than 2,600 rpm.

9. From the emergency (suction) mode of operation illustrated in block V the two fuel supply pumps EKP1 and EKP2 can be brought into the turned off condition illustrated in block II provided that after the completion of the suction and upon expiration of a predetermined time interval the rotary speed drops to zero or below a predetermined minimum value (n less than 10 rpm).

It is evident that due to the solution of the control of a pair of electrically controlled fuel supply pumps in accordance with this invention it is guaranteed that at a standstill condition of the engine or when its rotary speed drops below 10 rpm the two fuel supply pumps are turned off. Nevertheless, upon depression of the gas pedal from its idling or zero position (sfg is greater than LL) the two pumps are immediately reactivated (transition from block II to block I); in the case of a Diesel engine having a fuel injection pump EP controlled by a control rod of a Diesel engine control unit, the control rod is brought into its nominal position upon actuation of the starter thus improving the cold start. During the normal operation of the engine, when only one of the two fuel supply pumps is turned on, and a defect develops in the active pump the control device immediately switches over to the second fuel supply pump. The switchover is effected in such a manner that upon the recognition of a defect when the actual control value is smaller than the desired control value during the operation of the pumps indicated in block III, both pumps are turned on their normal forward fuel delivery as indicated in block IV.

While the invention has been illustrated and described as embodied in a Diesel engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of safeguarding operation of an internal combustion engine having a tank, a fuel metering device and an electrically controlled fuel pump for supplying fuel from said tank to said metering device, and means for injecting fuel into the engine in response to momentary operational conditions of the engine, comprising the steps of providing an additional electrically controlled fuel pump for supplying fuel from said tank to said metering device; activating both fuel supply pumps during starting operation when rotary speed of the engine has a low value n ; activating only one of said two fuel supply pumps during a normal engine operation when rotary speed n is greater than idling speed; and activating both fuel supply pumps into reverse run when an emergency operation occurs, whereby the two pumps suck fuel from said fuel metering device.

2. A method as defined in claim 1, wherein said internal combustion engine is a Diesel engine including an electric central control device controlling said fuel injection means via a control mechanism including a control rod, and said emergency operation resulting from a positive difference between the actual and nominal positions of said control rod or from the actual rotary speed exceeding a nominal maximum value for a predetermined time interval.

3. A method as defined in claim 1 or 2, wherein during normal operation of the engine said one of the two fuel supply pumps being activated at random.

4. A method as defined in claim 2 or 3, wherein during the starting condition of the engine when both fuel supply pumps are activated and rotary speed drops below a minimum limit of less than 10 rpm and the gas pedal remains in its idling position for a predetermined time period, then the two fuel supply pumps are turned off.

5. A method as defined in claim 4, wherein under the condition that rotary speed increases above said predetermined minimum limit or if the gas pedal is depressed from its idling position, said two fuel supply pumps are turned on into a starting mode of operation.

6. A method as defined in claim 1, wherein during said normal operation of the engine when only one of said fuel supply pumps is active and rotary speed drops below a predetermined minimum value, both fuel supply pumps are activated to operate under an engine starting condition.

7. A method as defined in claim 1, wherein during the normal operation of the engine when only one of said two fuel supply pumps is active and a defect condition is detected resulting for example from a malfunction of the control system, then both fuel supply pumps are turned on.

8. A method as defined in claim 7, wherein said internal combustion engine is a Diesel engine including an electric central control device controlling said fuel injection via a control mechanism including a rod, and said defect condition results from a negative difference between the actual and nominal positions of said control rod.

9. A method as defined in claim 7, wherein said emergency engine operation resulting in the reverse operation of both fuel supply pumps occurs upon the detection of a rotary speed exceeding a predetermined maximum speed limit $n_{max}$ for a time period $\Delta T_{max}$.

10. A method as defined in claim 2, wherein said emergency mode of operation of the engine occurs when the actual value of the control rod is greater than the nominal value plus 1 millimeter and the rotary speed of the engine is greater than 1,000 rpm for a predetermined time interval $\Delta T_{emergency}$.

11. A method as defined in claim 1, wherein the reversal of the operation of the two fuel supply pumps is effected by reversing polarity at their power supply terminals.

12. A method as defined in claim 1, wherein the two fuel supply pumps are switched over from their reverse mode of operation into their normal forward mode of operation during the normal operation of the engine when load of the engine is smaller than a nominal load value and the rotary speed is smaller than a predetermined maximum rotary speed.

* * * * *